United States Patent [19]

Driscoll

[11] 4,135,775

[45] Jan. 23, 1979

[54] MOVABLE DIVIDER PANELS WITH ELECTRICAL WIRING

[75] Inventor: Richard P. Driscoll, Kentwood, Mich.

[73] Assignee: Steelcase Inc., Grand Rapids, Mich.

[21] Appl. No.: 807,906

[22] Filed: Jun. 20, 1977

[51] Int. Cl.[2] ..... E04F 17/08; H01R 13/60

[52] U.S. Cl. ..... 339/22 R; 52/221; 339/23

[58] Field of Search ..... 339/20, 21 R, 22 R, 339/23; 52/28, 220, 221, 239, 242, 287, 292, 495, 587

[56] References Cited

U.S. PATENT DOCUMENTS

| | | | |
|---|---|---|---|
| 3,316,624 | 5/1967 | Brudevold | 52/221 X |
| 3,377,756 | 4/1968 | Polhamus | 52/220 |
| 4,043,626 | 8/1977 | Propst et al. | 339/23 |
| 4,056,297 | 11/1977 | Gartung | 339/23 |
| 4,060,294 | 11/1977 | Haworth et al. | 339/22 R X |

*Primary Examiner*—Roy Lake
*Assistant Examiner*—E. F. Desmond
*Attorney, Agent, or Firm*—Price, Heneveld, Huizenga & Cooper

[57] ABSTRACT

The specification discloses a movable room divider panel system in which the divider panels include raceways with removable covers and fixed electrical outlet boxes which are proportional in length from end to end to the width of their respective panels from edge to edge. Outlet boxes in adjacent panels are joined by flexible conduits enclosing electrical wiring, there being mating connectors on the ends of the flexible conduits and at the ends of the outlet boxes.

3 Claims, 15 Drawing Figures

MOVABLE DIVIDER PANELS WITH ELECTRICAL WIRING

BACKGROUND OF THE INVENTION

The present invention relates to movable room divider panels and wiring therefor.

Open office planning is based on the use of a plurality of movable room divider panels to divide a large open space into a plurality of different work stations. The area can thereafter be modified to accommodate different working conditions by simply rearranging the room divider panels.

One problem with the scheme is that of providing electrical wiring to the various work stations. Local codes and local inspectors often do not approve of getting power to work stations by running long lengths of electrical extension cords through raceways in the panels. To pass codes, the wiring must be permanent in nature with the wiring itself being inaccessible to the user. Often this requires locating an electrical outlet tombstone at virtually every work station location. This of course interferes with the desired mobility and rearrangeablility of the open face office room divider panel system.

One panel system is available with built-in wiring. Each panel is fitted with wiring and outlets and when the panels are joined, connection is effected between adjacent panels. The wiring is located in an enclosed raceway which is not accessible in the field.

A drawback to this system is that it is expensive and inflexible. You might buy some panels with power and some without, only to find that when you later rearrange the system, you don't have the right combination of power and nowpowered panels. It is of course expensive to buy all of the panels with power.

Another problem with the available system is that it is difficult to branch. In other words, where three divider panels come together, there is provision only for passing power between the two panels and special external adapters are required for branching off into the third or fourth panel.

SUMMARY OF THE INVENTION

In the movable room divider panel system of the present invention, the panels all have accessible raceways with readily removable covers, but the accessible raceways are filled with flexible conduit enclosed wiring with electrical connectors on the ends for connecting outlet boxes fixed in the raceways. There are mating connectors on the ends of the segments of flexible conduit and on the electrical outlet boxes.

Preferably, there are at least two connectors at the ends of the outlet boxes in order to allow for branching of the electrical wiring. Also it is preferable that the outlet box length be proportional to the panel width from end edge to end edge. As a result of the arrangement, the length of flexible conduit for connecting outlet boxes in additional panels can be the same regardless of the panel width.

BRIEF DESCRIPTION OF THE DRAWINGS

These and other objects, advantages and features of the present invention will be more fully understood and appreciated by reference to the written specification and appended drawings in which.

DESCRIPTION OF THE PREFERRED EMBODIMENT

Figure 1:
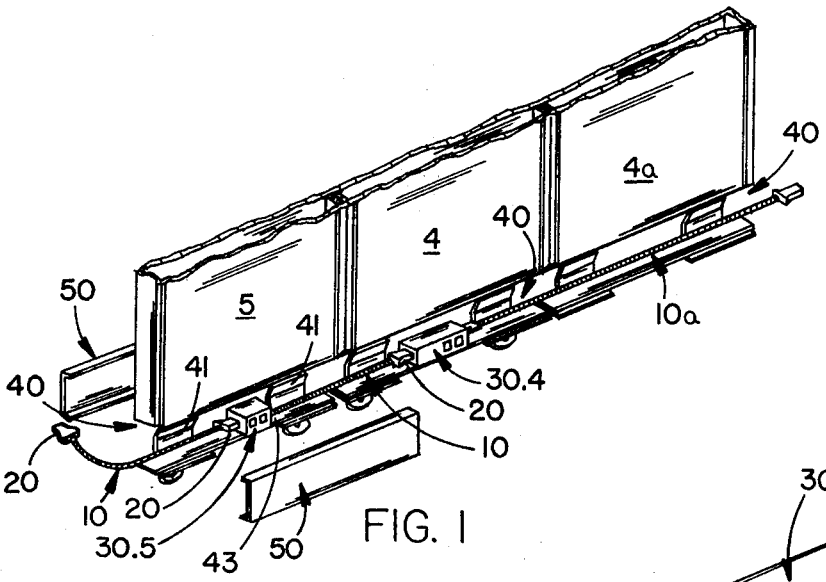
FIG. 1 is a fragmentary perspective view showing the bottom portions of three panels joined in aligned relationship.
Figure 2:
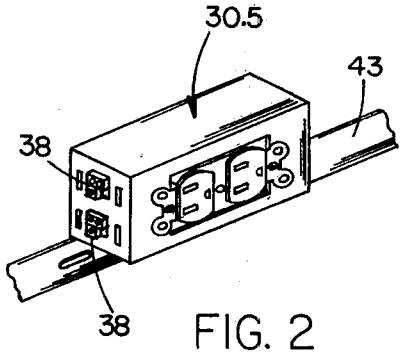
FIG. 2 is a perspective view of an outlet box.

In the preferred embodiment, a plurality of movable panels such as 4 and 5 in FIG. 1 each includes an open raceway 40 at the bottom thereof which can be covered with removably mounted raceway covers 50. Located in some of the raceways 40 are electrical outlet boxes such as outlet boxes 30.4 and 30.5 shown in FIG. 1. The outlet boxes are electrically connected by flexible conduit 10 housing electrical wiring and having male connectors 20 at each end for connecting with female connectors 38 (FIG. 2) located in the ends of the electrical outlet boxes. Panel **4*a* is just like panel 4, except that it does not include an electrical outlet box and accordingly, a longer length of flexible conduit 10*a*** passes therethrough.

In this way, electrical wiring is provided to movable divider panel systems in a way which is flexible and yet which will pass electrical codes in that the electrical wiring is all enclosed in flexible conduit. The system is easily changeable since one can simply unplug the various lengths of flexible conduit 10, rearrange the panels and then plug them in again when the system is rearranged.

The flexible conduit 10 is conventional aluminum flexible conduit. (See FIGS. 1 and 7) The internal wiring 11 carried therethrough is also conventional and is joined at its ends to male connectors 20.

Figure 7:
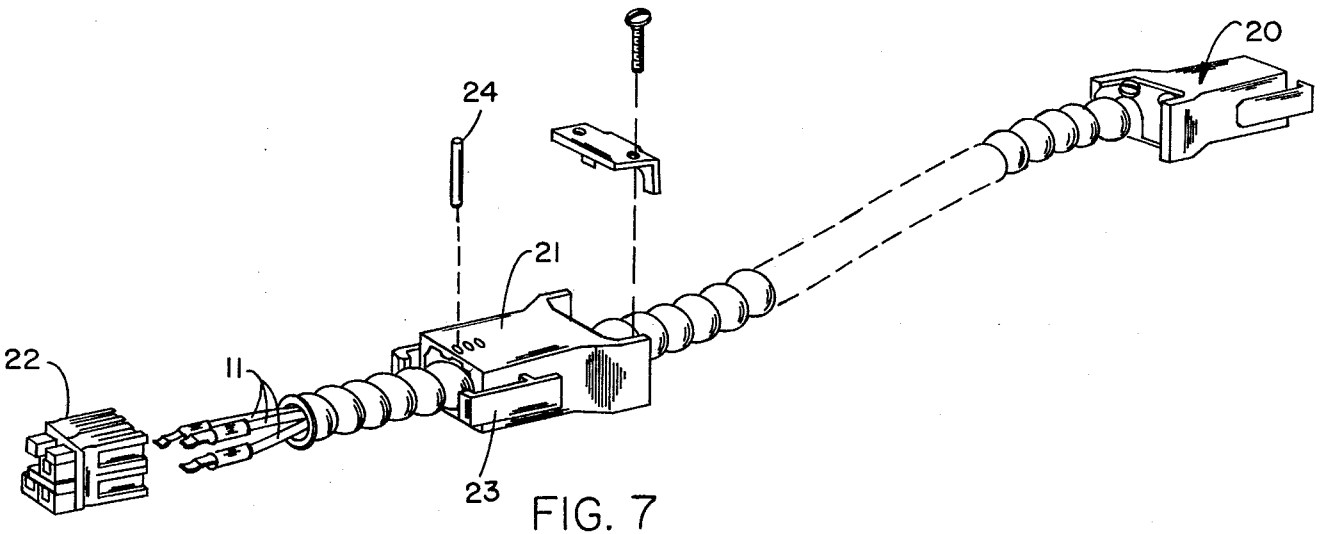
FIG. 7 is an exploded view showing the construction of the flexible conduit enclosed wiring.
Figure 8:
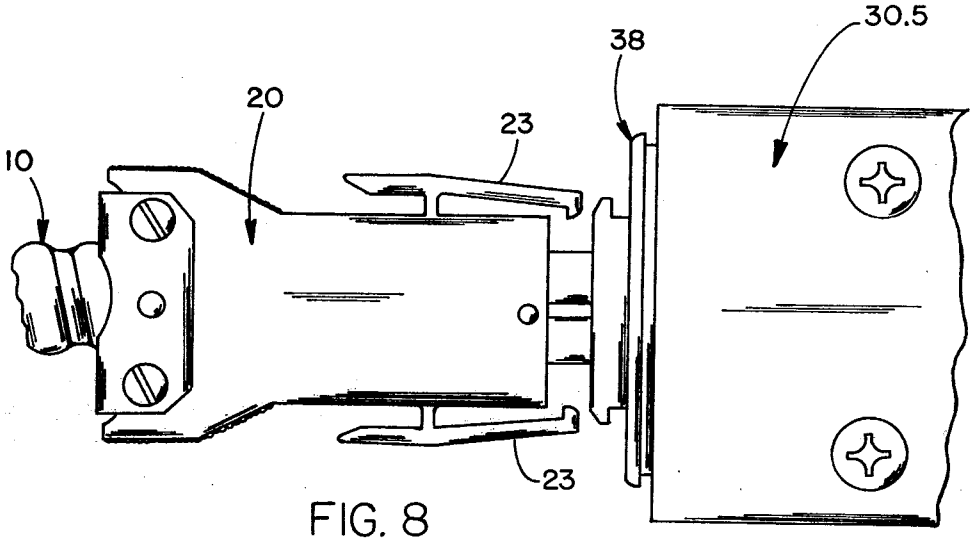
FIG. 8 is an enlarged view showing the manner in which the flexible conduit connectors join to outlet box connectors.

Each male connector 20 comprises a body 21 and a prong unit 22 (FIG. 7). The wiring 11 is connected to prong unit 22 in a conventional manner and prong unit 22 then fits within body 21 and is pinned in place as for example by pin 24. Body 21 includes securing fingers 23 which can be flexed outwardly to allow connection and disconnection to the female connector 38 (FIG. 8). In this way, male connector 20 can be positively secured to female connector 38, and yet is readily releasable by simply depressing the ends of fingers 23.

The flexible conduits 10 for joining the outlet boxes in adjacent panels are all of the same length, regardless of the width of the panels in which the electrical boxes are located. This is made possible by the fact that the outlet boxes 30.1 through 30.5 are all proportional in length to the width, from end edge to end edge, of the particular panels in which they are located (see FIGS. 5A through 5F). In the system of the preferred embodiment, panel 1 is a 48" panel, panel 2 is a 42" panel, panel 3 is a 36" panel, panel 4 is a 30" panel, and panel 5 is a 24" panel. The outlet box 30.1 for panel 1 is approximately 26" in length, leaving 11" between each of its ends and the end edges of panel 1. Similarly, outlet box 30.2 is 20", leaving 11" between each of its ends and the end edges of its panel 2. In a similar manner, the outlet boxes 30.3 through 30.5 have the differing lengths indicated in the drawing, thereby leaving 11" in each case from the ends of the outlet boxes to the end edges of their respective panels. As a result of this arrangement, each flexible conduit 10 is approximately 22" in length and can be used to join any two outlet boxes in adjacent panels regardless of the panel widths.

Figure 5A:
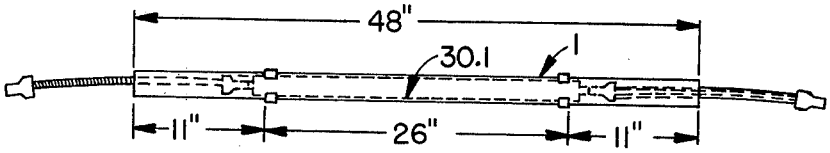
FIGS. 5A through 5F show the varying sized panels which can be provided in the system and show the relationship of the size of the electrical outlet boxes to the differing width panels.
Figure 5B:
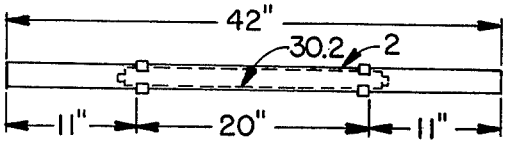
Figure 5C:
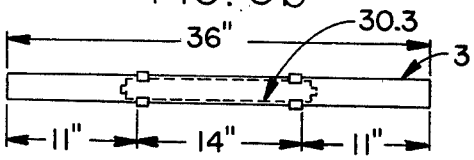
Figure 5E:
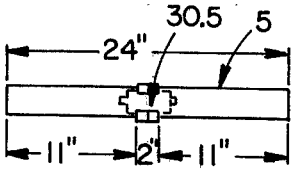
Figure 5D:
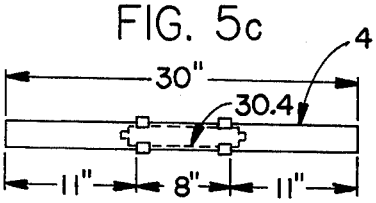
Figure 5F:
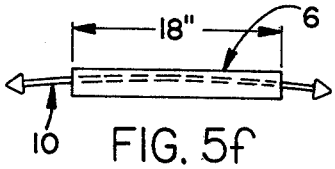

In the overall system, some of the panels, such as panel 6 shown in FIG. 5F, may not be provided with outlet boxes. Panel 6 is an 18" panel and is so small that an outlet box would not be particularly useful. In FIG. 1, a panel **4*a* is shown which, like panel 4 is 30" in width, and yet which as an option to the customer is not provided with an outlet box. For passing through panels such as 6 and 4*a* varying lengths of flexible conduit 10*a*** can be provided as part of the system.

Figure 6:
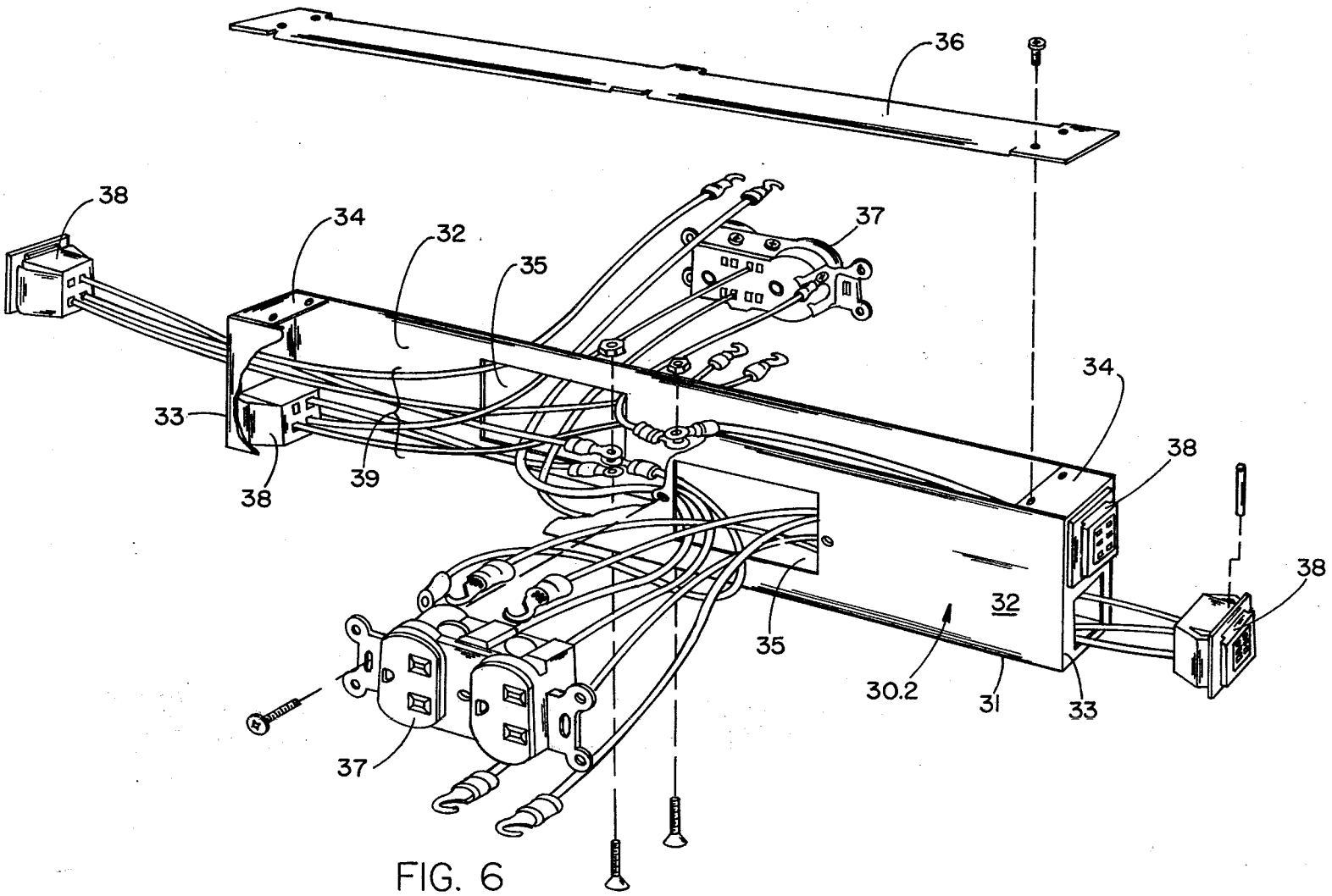
FIG. 6 is an exploded view showing the construction of an electrical outlet box.

The basic construction of each outlet box is the same with the only difference being length. FIG. 6 shows an exploded view of the construction of electrical outlet box 30.2. The box is formed of metal and includes a bottom wall 31, sidewalls 32, ends 33 and a top 34 which is generally open except for small flanges at each end. Openings 35 are provided in the sides 32 of each outlet box for receiving electrical outlets 37. The electrical outlets 37 are joined by internal wiring 39 to a pair of female connectors 38 at each end of the outlet box. The electrical wiring 39 itself is, like the internal wiring 11 in flexible conduit 10, conventional in nature and will be readily understood by any electrician. Accordingly, none of this wiring is described in any particular detail herein. Once the wiring is completed, the opening in the top 34 of the electrical outlet box is covered by cover 36 which is securely fastened by screws so that it is not accessible to the user in the field, and is only accessible to a repairman having appropriate tools in the event repair is necessary.

Figure 3:
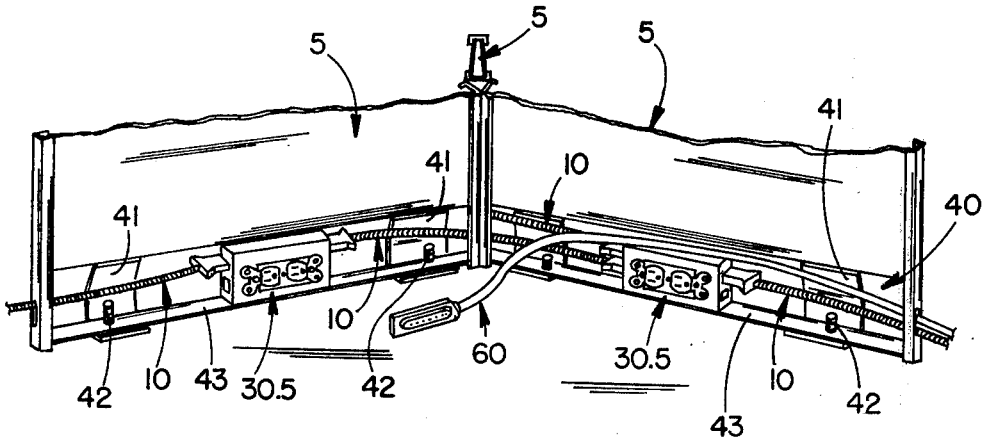
FIG. 3 is a fragmentary perspective view showing the bottom portions of three divider panels joined at an angle with wiring branching into all three panels.
Figure 4A:
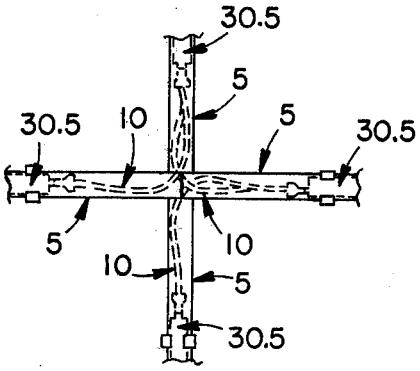
FIG. 4A is a schematic view showing branching where four partitions are joined together at right angles to one another.
Figure 4B:
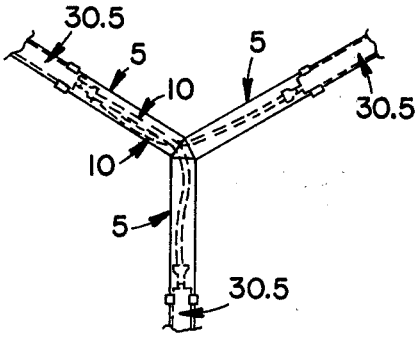
FIG. 4B is a schematic view showing branching where three panels are joined at 120° with respect to one another.
Figure 4C:
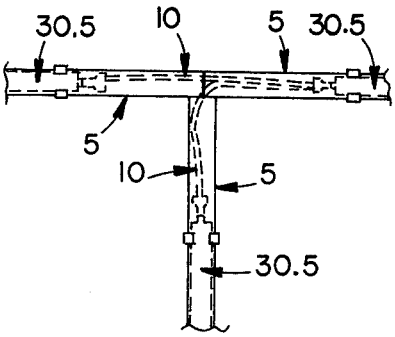
FIG. 4C is a schematic view showing three panels joined together in which two are aligned and one is joined to the other two at right angles thereto.

It is important that each outlet box 30.1 through 30.5 includes two female connectors 38 at each end. This makes possible various branching arrangements of electrical wiring as illustrated in FIG. 3 and 4A through 4C. In FIG. 3, it can be seen that three 24" panels 5 have joined at 120° to one another. It can be seen that in the panel on the right in the foreground in FIG. 3, there are two flexible conduit connectors 10 joined to the left end of the outlet box 35. Ones goes to the outlet box in the panel 5 in the left foreground, while the other extends rearwardly into the third panel 5 projecting to the rear of the perspective view. The same arrangement is readily visible in the schematic shown in FIG. 4B. FIGS. 4A and 4C show other arrangements in which branching off of power is facilitated because there are two female connectors 38 at each end of each electrical outlet box 30.1 through 30.5.

The raceways 40 at the bottom of each of the panels are defined by spaced feet 41 (FIGS. 1 and 3) including appropriate levelers 42. Extending between the feet is a platform 43 comprising a strip of metal or the like. Each of the outlet boxes is securely fastened by screws or the like to platform 43 (see also FIG. 2).

Each raceway has a readily releasably secured cover 50 (FIG. 1). This allows ready access to the raceway to facilitate plugging and unplugging and otherwise rearranging the conduits 10 and the panels. Cover 50 snap fits into position. The details of such an arrangement are not critical to the invention, and one snap fitting arrangement is disclosed in U.S. Pat. No. 3,802,146 issued Apr. 9, 1974 and entitled "Panel System".

Another advantage of the flexible conduit system of the present invention is shown in FIG. 3. A telephone line 60 is shown lying in the raceway 40 of the panel 5 in the right foreground. Because the electrical wiring is enclosed within the flexible conduit 10, the telephone cable 60 can lie in the same raceway without the need for any physical divider therein.

As a result of the present invention, removable room divider panels can readily be provided with electrical wiring which will pass local codes, and yet which is consistent with the desired flexibility and mobility of the office panel system. The user can readily open the wiring raceways, disconnect the flexible conduit connectors, rearrange the panels and then reconnect the conduit connectors.

Of course, it is understood that the above is merely a preferred embodiment of the invention and that various changes and alterations can be made without departing from the spirit and broader aspects thereof.

The embodiments of the invention in which an exclusive property or privilege is claimed are defined as follows:

1. A movable room divider panel system comprising: at least two movable panels of differing widths from one end edge to the other, each including an accessible raceway therethrough and a readily releasably mounted cover over said raceway whereby said cover can be removed to allow access to said raceway; an outlet box positioned within each said raceway having at least one electrical outlet; said outlet box and said raceway having relative dimensions which allow communication wiring to be placed within said raceway in addition to said outlet box; at least one electrical connector at each end of said electrical outlet; electrical wiring and flexible conduit enclosing said electrical wiring and having an electrical connector at each end of said conduit capable of matingly engaging said electrical connectors in said outlet boxes whereby said flexible conduit can be located within said raceways and used to electrically connect said outlet boxes in said two panels; said outlet boxes being of differing lengths, each being proportional in length to said width of its respective panel whereby the flexible conduit connectors employed to join electrical outlet boxes in adjacent panels can be of a uniform length regardless of the width of the adjacent panels.

2. The movable room divider panel system of claim 1 in which at least two connectors are located at each end of each said electrical outlet box whereby said panels and said flexible connectors can be arranged to provide for power going to three or more adjacently joined panels.

3. The movable room divider panel system of claim 1 in which at least two connectors are located at each end of each said electrical outlet box whereby said panels and said flexible connectors can be arranged to provide for power going to three or more adjacently joined panels.

* * * * *